US010883731B2

(12) United States Patent
Yan et al.

(10) Patent No.: US 10,883,731 B2
(45) Date of Patent: Jan. 5, 2021

(54) AIR PURIFIER WITH INDEPENDENT DUAL CHANNEL

(71) Applicants: Jason Yan, New Taipei (TW); Wen-Lung Kan, New Taipei (TW)

(72) Inventors: Jason Yan, New Taipei (TW); Wen-Lung Kan, New Taipei (TW)

(73) Assignee: Jason Yan, New Taipei (TW)

( * ) Notice: Subject to any disclaimer, the term of this patent is extended or adjusted under 35 U.S.C. 154(b) by 184 days.

(21) Appl. No.: 16/189,788

(22) Filed: Nov. 13, 2018

(65) Prior Publication Data

US 2020/0149755 A1 May 14, 2020

(51) Int. Cl.
*F24F 1/02* (2019.01)
*F24F 3/16* (2006.01)

(52) U.S. Cl.
CPC ..... *F24F 3/1603* (2013.01); *F24F 1/02* (2013.01); *F24F 2003/1614* (2013.01); *F24F 2003/1628* (2013.01); *F24F 2003/1653* (2013.01); *F24F 2003/1667* (2013.01)

(58) Field of Classification Search
CPC .... F24F 3/1603; F24F 1/02; F24F 2003/1667; F24F 2003/1628; F24F 2003/1653; F24F 2003/1614; B01D 46/0024; B01D 46/0049
USPC ..... 55/422, 467, 471–473, DIG. 34; 96/16, 96/80, 97, 224; 422/120
See application file for complete search history.

(56) References Cited

U.S. PATENT DOCUMENTS

| | | | | |
|---|---|---|---|---|
| 10,697,665 | B2 * | 6/2020 | Jung | B01D 46/2403 |
| 2015/0306533 | A1 * | 10/2015 | Matlin | F24F 11/30 96/420 |
| 2015/0354874 | A1 * | 12/2015 | Cur | F24F 3/1603 62/216 |
| 2016/0184753 | A1 * | 6/2016 | Chu | F24F 1/0071 96/74 |
| 2017/0246570 | A1 * | 8/2017 | Park | F24F 1/005 |
| 2017/0246572 | A1 * | 8/2017 | Park | F24F 3/1603 |
| 2017/0246577 | A1 * | 8/2017 | Jung | B01D 46/0019 |
| 2017/0246579 | A1 * | 8/2017 | Mun | B01D 46/442 |
| 2017/0246580 | A1 * | 8/2017 | Bae | B01D 46/0047 |
| 2017/0246581 | A1 * | 8/2017 | Jung | B01D 46/0047 |
| 2017/0246582 | A1 * | 8/2017 | Park | F24F 11/30 |
| 2017/0248339 | A1 * | 8/2017 | Mun | F04D 29/462 |
| 2019/0264948 | A1 * | 8/2019 | Jung | B01D 46/2403 |
| 2020/0003440 | A1 * | 1/2020 | Kim | B01D 46/0086 |
| 2020/0158357 | A1 * | 5/2020 | Son | B01D 46/2411 |

* cited by examiner

*Primary Examiner* — Minh Chau T Pham
(74) *Attorney, Agent, or Firm* — Muncy, Geissler, Olds & Lowe, P.C.

(57) ABSTRACT

The invention provides an air purifier with independent duel channel, which has separate first channel portion and second channel portion, wherein the first channel portion is used to filter particulate matters in the air and the second channel portion is used to purify the air. The invention mainly separates the channels and processes of the filtered air and the purified air, and more matches the selection of specific suction fan and intake fan so as to meet the different flow velocities required for air filtration and purification respectively, thereby achieving the optimal air filtration and purification effects, and improving the ineffective problem caused by the simultaneous filtration and purification of the air in the same channel of the existing air purifier.

8 Claims, 5 Drawing Sheets

AIR PURIFIER WITH INDEPENDENT DUAL CHANNEL

FIELD OF THE INVENTION

The invention belongs to the field of air purifier, in particular to an air purifier with independent dual channel.

BACKGROUND OF THE INVENTION

With the rapid development of industry leading to diversified air pollution emissions accompanying climate change caused by a large number of particulate matters harmful to the living environment, has become one of the main indicators for assessing the degree of air pollution. Particulate matters can stay in the atmosphere for a long time, and can enter the body with respiration, accumulate in the trachea or lungs, which is very harmful to human health. Fog, dust, pollen, dandruff and smog, etc. in daily life can be the particulate matters that may cause human discomfort.

Nowadays, the common way to eliminate indoor particulate matter is to place air purifiers indoors and to purify the air through internal circulation. In the process of purifying the air, the existing air purifier adopts the suction fan and the intake filter mesh to suck the air into the air purifier for preliminary filtration, and then uses the photocatalyst and ultraviolet light set in the air purifier to achieve the purpose of disinfection and sterilization. However, in order to filter fine particulate matters in the air, it is necessary to use the intake filter mesh with finer porosity, so the suction force of the suction fan must be increased to overcome the high resistance of the finer mesh and suck proper amount of air smoothly into the channel of the air purifier for further disinfection and sterilization, for example, using photocatalyst and ultraviolet light. In the above process of the existing air purifier, because the air flow introduced into a single channel has the same speed, it is impossible to simultaneously take into account both the need for high-speed air flow provided by the high-suction fan for overcoming the filtration process of the high flow resistance filter mesh, and the need for low-speed air flow provided by the low-suction fan for carrying out the purification process requiring longer residence time. Therefore, these two purification processes on the existing air purifier lead to the problem of either unable to cope with one without letting go of the other, or the processing effects of both are not complete.

It can be seen that there are still many shortcomings in the conventional air purifier. In order to take into account the two functions of air filtration and air purification to promote the overall efficiency of the air purifier, the conventional air purifier needs to be improved urgently.

SUMMARY OF THE INVENTION

The invention provides an air purifier with independent dual channel, which mainly comprises a first channel portion and a second channel portion. The first channel portion filters particulate matters in the air and the second channel portion purifies the air. The first channel portion includes a filtration channel, a suction fan and a filter mesh. The suction fan is arranged between the suction end and the exhaust end in the filtration channel to provide suction for passing the outside air through the filter mesh arranged near the suction fan towards the suction end side of the filtration channel, and then the air of the filtered particulate matters is sucked into the filtration channel and sent out to the exhaust end. The second channel portion includes a purification channel, an intake fan and an air purification module. The intake fan is arranged between an inlet end and an outlet end in the purification channel to provide suction for sucking air into the purification channel, and the purified air is sent out from the outlet end by the air purification module arranged in the inlet end.

The bore of the filtration channel gradually expands from the suction end to the exhaust end. The first channel portion further includes a particulate matter detection module adjacent to the exhaust end.

The bore of the purification channel gradually expands from the inlet end to the outlet end, and the air purification module is one or combination of an ozone generator, a photocatalyst sterilizer and an anion generator.

The suction fan is a swirl-flow fan, which provides greater suction for the outside air to overcome the resistance of the filter mesh and enter the filtration channel to achieve filtering effect. The intake fan is an axial-flow fan, which provides less suction to prolong the residence time of the air in the purification channel to achieve the effect of fully purifying the air.

Air purifier with independent dual channel of the invention further comprises a shell portion which accommodates the first channel portion and the second channel portion therein, and the shell portion comprises a front cover, a rear cover, a left cover, a right cover, an upper cover and a lower cover; wherein the front cover is connected with one end of the purification channel, and an inlet port is arranged on the front cover corresponding to the inlet end of the purification channel; wherein the rear cover is connected with the other end of the purification channel, and an outlet port is arranged on the rear cover corresponding to the outlet end of the purification channel; wherein the left cover is arranged on one side of both the filtration channel and the purification channel; wherein the right cover is arranged on the other side of both the filtration channel and the purification channel, and a suction port is arranged on the right cover corresponding to the suction end of the filtration channel; wherein the upper cover is connected with one end of the filtration channel, and an exhaust port is arranged on the upper cover corresponding to at the exhaust end of the filtration channel; and wherein the lower cover is arranged at the bottom of the purification channel. The right cover further includes a filter mesh fixture, and the filter mesh is clamped between the filter mesh fixture and the suction port of the right cover.

BRIEF DESCRIPTION OF THE DRAWINGS

The techniques of present invention would be more understandable from the detailed description given herein below and the accompanying figures are provided for better illustration, and thus description and figures are not limitative for present invention, and wherein.

DETAILED DESCRIPTION OF THE PREFERRED EMBODIMENT

Figure 1:
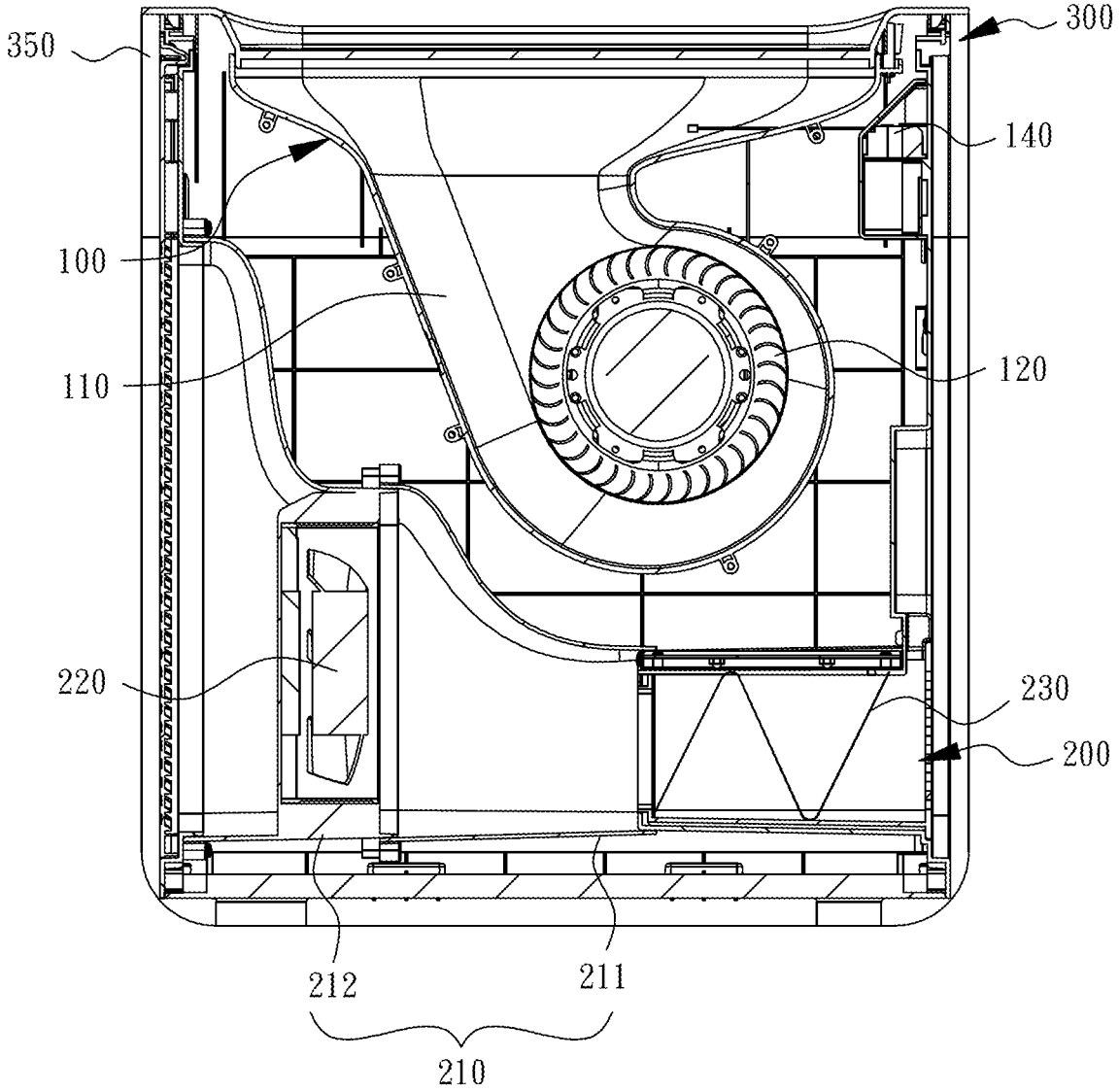
FIG. 1 is a schematic diagram illustrating sectional view of an air purifier with independent dual channel of the present invention.
Figure 2:
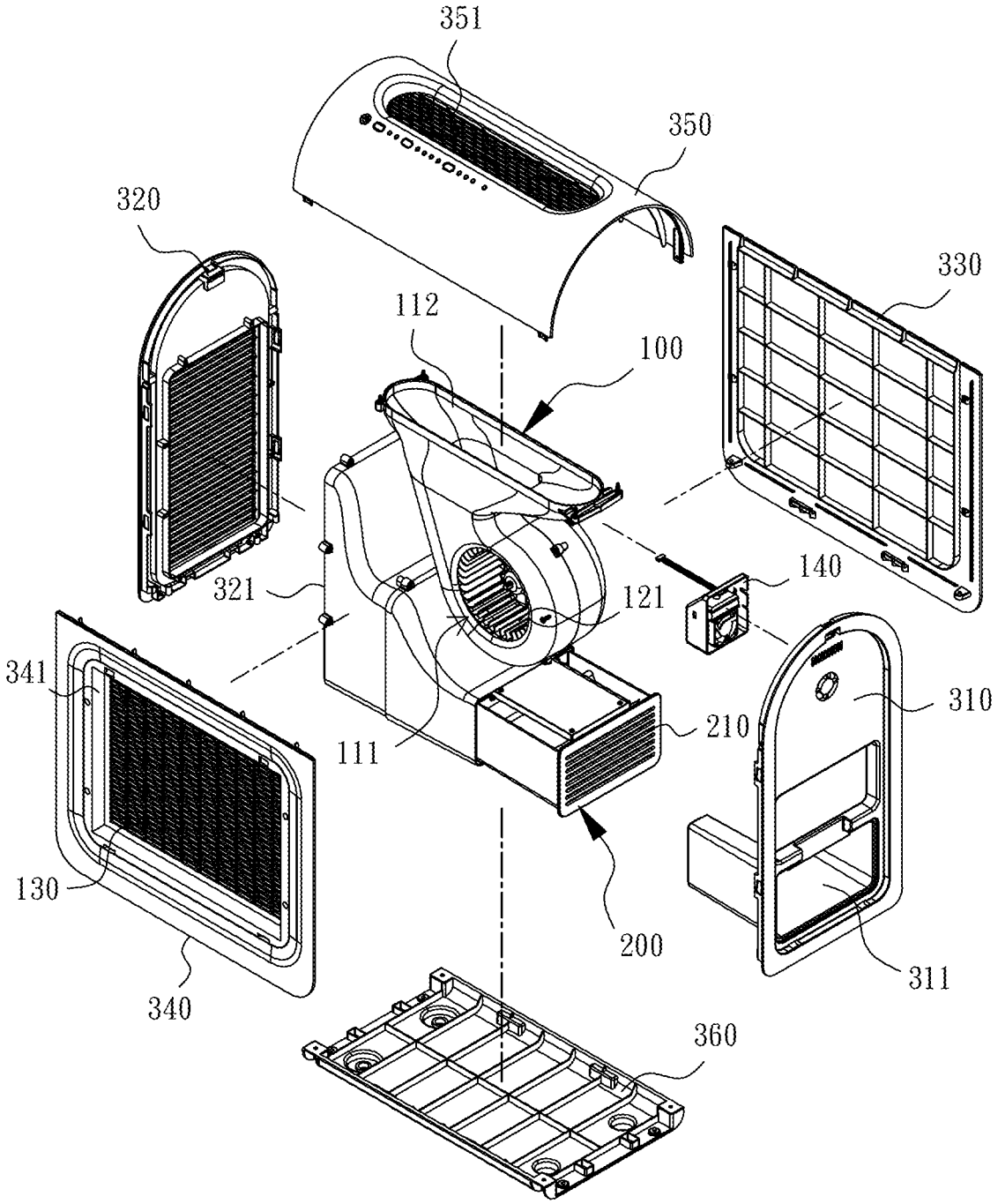
FIG. 2 is a schematic diagram illustrating exploded view of the air purifier with independent dual channel of the present invention.

Please refer to FIG. 1 and FIG. 2 for schematic diagrams illustrating sectional and exploded views of the air purifier with independent dual channel of the present invention. As shown in the diagrams, the air purifier mainly comprises a first channel portion 100 and a second channel portion 200, which are accommodated in a shell portion 300. The first channel portion 100 includes a filtration channel 110, a suction fan 120 and a filter mesh 130. The suction fan 120 is arranged between a suction end 111 and an exhaust end 112 in the filtration channel 110 to provide suction for passing the external air through the filter mesh 130 located near the suction fan 120 towards the suction end 111 of the filtration channel 110, and then the air of the filtered particulate matters is sucked into the filtration channel 110 and discharged by the exhaust end 112. The first channel portion 100 further includes a particulate matter detection module 140 adjacent to the exhaust end 112 of the filtration channel 110 for detecting the particulate matter concentration in the filtration channel 110. The second channel portion 200 includes a purification channel 210, an intake fan 220 and an air purification module 230. The intake fan 220 is arranged between an inlet end 211 and an outlet end 212 in the purification channel 210 to provide suction for sucking air into the purification channel 210, and the purified air is discharged by the outlet end 212 via the air purification module 230 arranged in the inlet end 211.

Further referring to FIG. 2, the shell portion 300 comprises a front cover 310, a rear cover 320, a left cover 330, a right cover 340, an upper cover 350 and a lower cover 360; wherein the front cover 310 is connected with one end of the purification channel 210, and an inlet port 311 is arranged on the front cover 310 corresponding to the inlet end 211 of the purification channel 210; wherein the rear cover 320 is connected with the other end of the purification channel 210, and an outlet port 321 is arranged on the rear cover 320 corresponding to the outlet end 212 of the purification channel 210; wherein the left cover 330 is arranged on one side of both the filtration channel 110 and the purification channel 210; wherein the right cover 340 is arranged on the other side of both the filtration channel 110 and the purification channel 210, and a suction port 341 is arranged on the right cover 340 corresponding to the suction end 111 of the filtration channel 110; wherein the upper cover 350 is connected with one end of the filtration channel 110, and an exhaust port 351 is arranged on the upper cover 350 corresponding to at the exhaust end 112 of the filtration channel 110; and wherein the lower cover 360 is arranged at the bottom of the purification channel 210. The right cover 340 further includes a filter mesh fixture 342, and the filter mesh 130 is clamped between the filter mesh fixture 342 and the suction port 341 of the right cover 340.

Figure 3:
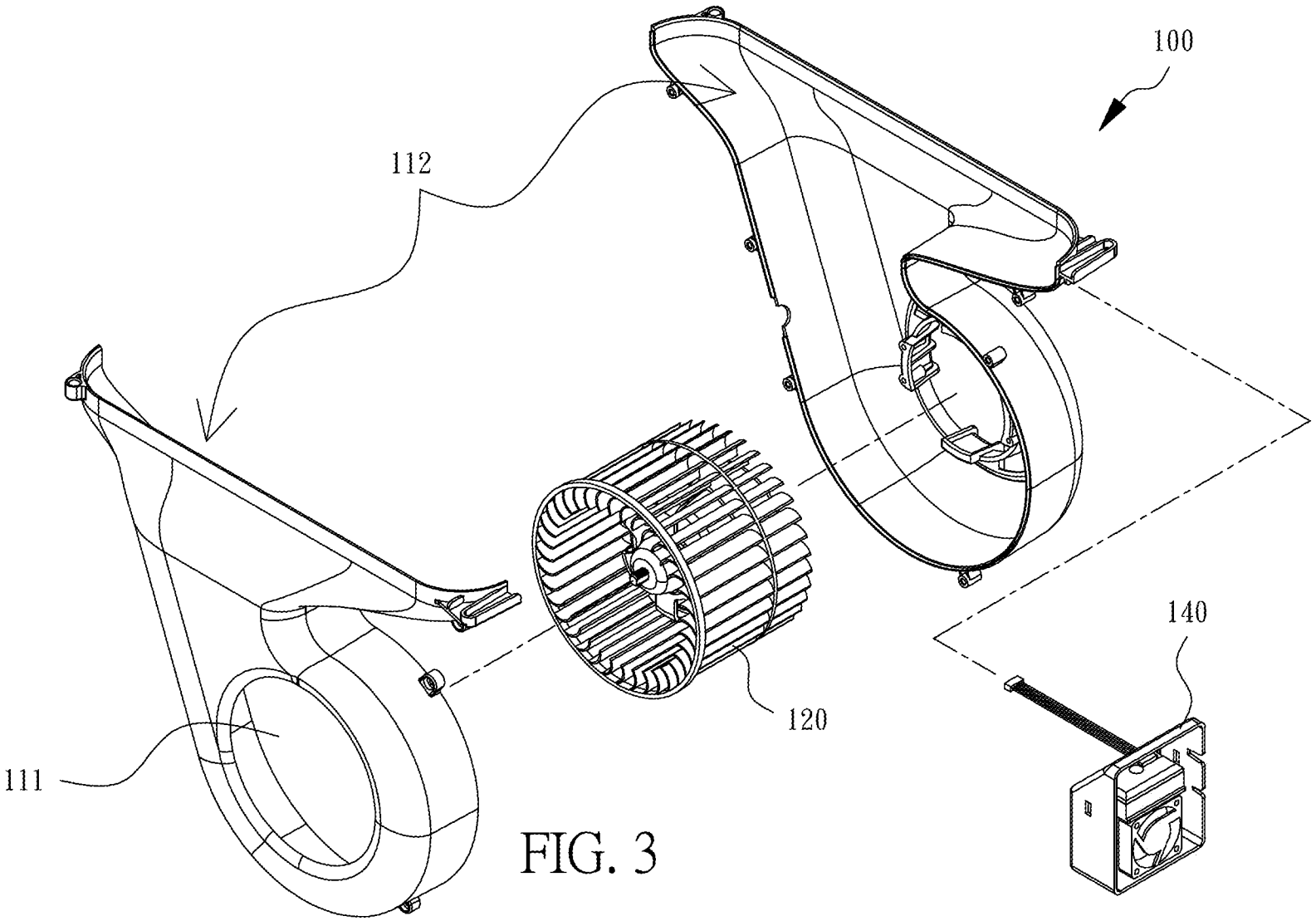
FIG. 3 is a schematic diagram illustrating exploded view of a first channel portion of the present invention.

Please refer to FIG. 3 for a schematic diagram illustrating sectional and exploded view of the first channel portion 100 of the present invention and FIG. 2. When the suction fan 120 sucks air into the filtration channel 110 from the outside via the filter mesh 130, the suction port 341 and the suction end 111, the filter mesh 130 can filter particulate matters in the air, wherein the suction fan 120 adopts a swirl-flow fan to provide greater suction for the outside air to overcome the resistance of the filter mesh 130, and through a plurality of swirl blades 121 arranged around the suction fan 120 achieve the effect of making the filtered air evenly enter the filtration channel 110. The bore of the filtration channel 110 is gradually expanded from the suction end 111 to the exhaust end 112, which can further slowdown the filtered air toward the exhaust end 112. Thus, the air purifier of the invention achieves the air circulation effect of full filtration and uniform diffusion.

Figure 4:
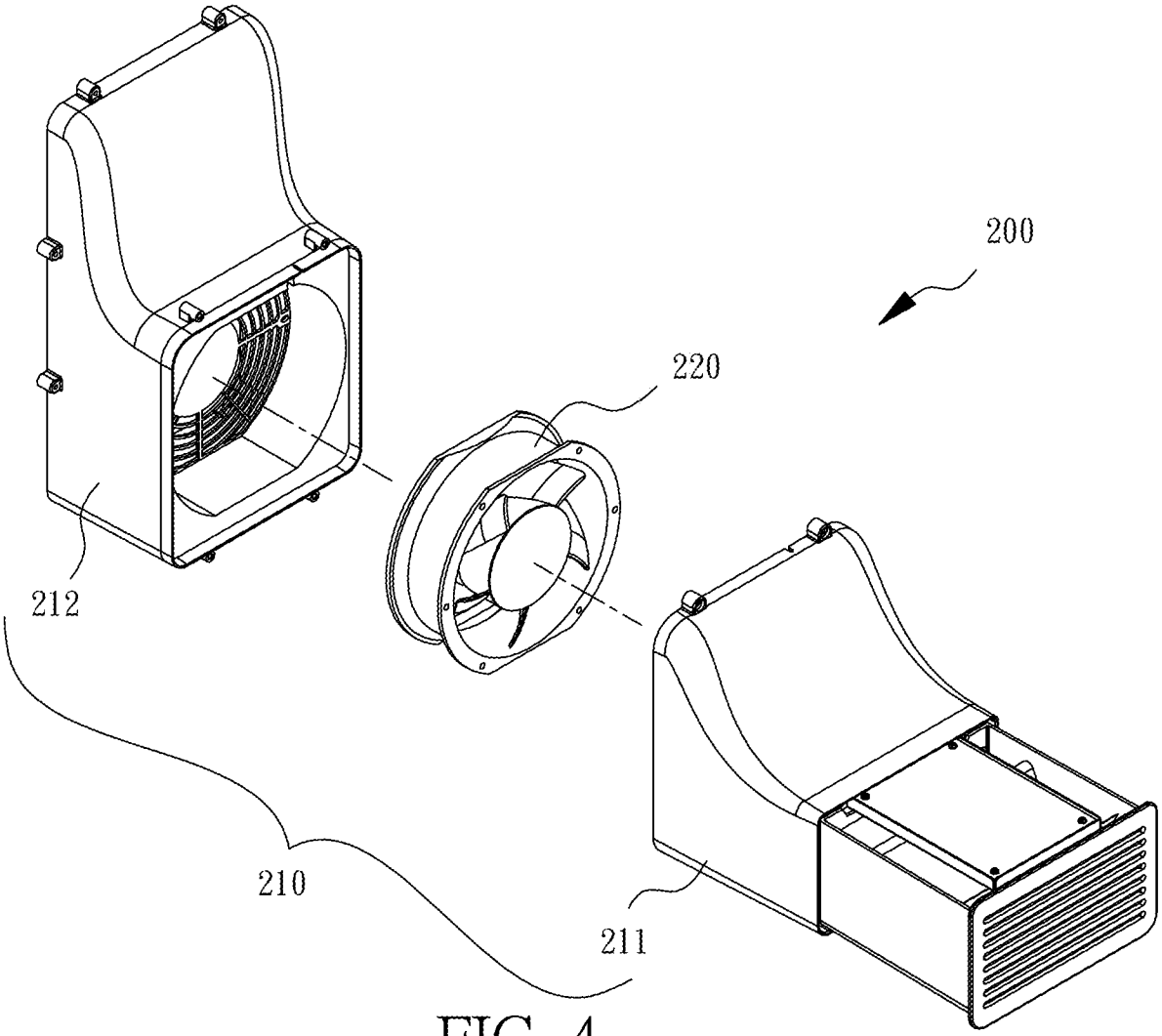
FIG. 4 is a schematic diagram illustrating exploded view of a second channel portion of the present invention.

Please refer to FIG. 4 for a schematic diagram illustrating sectional and exploded view of the second channel portion 200 of the present invention and FIG. 2. The intake fan 220 arranged between the inlet end 211 and the outlet end 212 can be an axial-flow fan, and the air purification module 230 is arranged in the inlet end 211 within the purification channel 210, wherein the bore of the purification channel 210 is gradually expanded from the inlet end 211 to the outlet end 212. When the intake fan 220 sucks outside air from the inlet end 211, the air in the purification channel 210 is purified by the air purification module 230, wherein of the intake fan 220 employs the weaker suction provided by the axial-flow fan to prolong the residence time of the air in the purification channel 210, thereby enabling the air to be fully purified via the air purification module 230, and wherein the air purification module 230 is one or combination of an ozone generator, a photocatalyst sterilizer and an anion generator. Thus, the air purifier of the invention achieves the air circulation effect of full purification and uniform diffusion.

Figure 5:
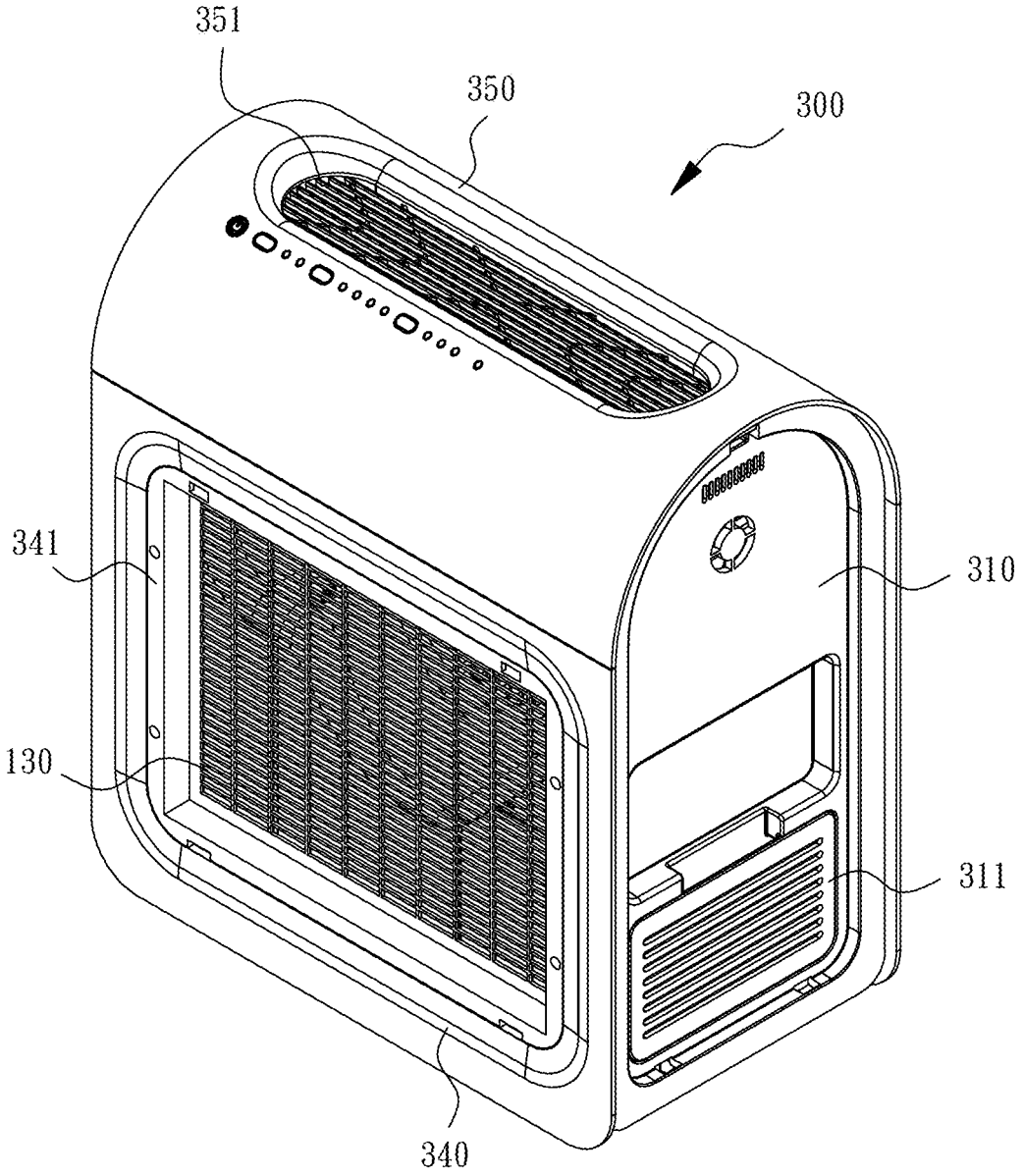
FIG. 5 is a schematic diagram illustrating perspective view of the air purifier with independent dual channel of the present invention.

Please refer to FIG. 5 for a schematic diagram illustrating perspective view of the air purifier with independent dual channel of the present invention and aforesaid FIG. 1 to FIG. 4. By the suction fan 120 arranged in the first channel portion 100, the outside air is sequentially passed through the suction port 341 of the right cover 340, and the particulate matters in the air are filtered through the filter mesh 130, and the filtered air is sucked into the filtration channel 110 through the suction end 111, the filtered air is then sent out through the exhaust end 112 and the exhaust port 351 on the upper cover 350. By the intake fan 220 arranged in the second channel portion 200, the outside air is sequentially passed through the inlet port 311 of the front cover 310, sucked into the purification channel 210 through the inlet end 211 and purified by the air purification module 230, the purified air is then sent out through the outlet end 212 and the outlet port 321 on the rear cover 320.

The present invention is based on the fact that the existing air purifier is to complete two processes of air filtration and air purification by air passing through a single channel. However, in practice, the same air velocity in the single channel cannot simultaneously meet the processing requirements of the above two different functions, thereby leading to the problem of either unable to cope with one without letting go of the other, or the processing effects of both are not complete. In order to solve the aforesaid problems of the existing technology, an air purifier with independent dual channel is proposed, which not only separates the channels for processing air filtration and air purification, but also more matches the selection of suction fan and intake fan according to their specific air flow speed requirements, so as to deal with the filtration and purification processes independently. Thus, the overall performance of the air purifier with independent dual channel of the invention can be significantly improved through optimal air filtration and air purification effects.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An air purifier with independent duel channel, mainly comprising:

a first channel portion and a second portion;

wherein the first channel portion includes a filtration channel that is provided with a suction end and an exhaust end, a suction fan that is arranged between the suction end and the exhaust end in the filtration channel, providing suction to suck air into the filtration channel from the suction end and send the air out from the exhaust end, wherein the suction fan is a swirl-flow fan, a filter mesh that is arranged near the suction fan towards the suction end side of the filtration channel; and wherein the second channel portion includes a purification channel that is provided with an inlet end and an outlet end, an intake fan that is arranged between the inlet end and the outlet end in the purification channel, providing suction to suck air from the inlet end into the purification channel and send the air out from the outlet end, wherein the intake fan is an axial-flow fan, an air purification module that is arranged in the inlet end of the purification channel;

wherein the suction fan provided greater suction for the outside air to overcome the resistance of the filter mesh, wherein the intake fan provided less suction to prolong the residence time of the air in the purification channel.

2. The air purifier with independent duel channel of claim 1, wherein the air purifier further comprises a particular matter detection module arranged near the exhaust end.

3. The air purifier with independent duel channel of claim 1, wherein a bore of the filtration channel gradually expands from the suction end to the exhaust end.

4. The air purifier with independent duel channel of claim 1, wherein a bore of the purification channel gradually expands from the inlet end to the outlet end.

5. The air purifier with independent duel channel of claim 1, wherein the air purification module is one or combination of an ozone generator, and a photocatalyst.

6. The air purifier with independent duel channel of claim 1, wherein the air purifier further comprises a shell portion which accommodates the first channel portion and the second channel portion therein.

7. The air purifier with independent duel channel of claim 6, wherein the shell portion includes a front cover that is connected with one end of the purification channel, and an inlet port is arranged on the front cover corresponding to the inlet end of the purification channel;

a rear cover that is connected with the other end of the purification channel, and an outlet port is arranged on the rear cover corresponding to the outlet end of the purification channel;

a left cover that is arranged on one side of both the filtration channel and the purification channel;

a right cover that is arranged on the other side of both the filtration channel and the purification channel, and a suction port is arranged on the right cover corresponding to the suction end of the filtration channel;

an upper cover that is connected with one end of the filtration channel, and an exhaust port is arranged on the upper cover corresponding to at the exhaust end of the filtration channel;

a lower cover that is arranged at the bottom of the purification channel.

8. The air purifier with independent duel channel as claimed in claim 7, wherein the right cover further includes a filter mesh fixture, and the filter mesh is clamped between the filter mesh fixture and the suction port of the right cover.

* * * * *